US012352169B2

(12) United States Patent
Wan et al.

(10) Patent No.: US 12,352,169 B2
(45) Date of Patent: Jul. 8, 2025

(54) HYDRAULIC SUPPORT WITH QUICK RESPONSE FUNCTION FOR COAL WALL SPALLING

(71) Applicant: Shandong University of Science and Technology, Shandong (CN)

(72) Inventors: Lirong Wan, Qingdao (CN); Xiaoqi Ma, Qingdao (CN); Qingliang Zeng, Qingdao (CN); Zhiyuan Sun, Qingdao (CN); Wenqian Xu, Qingdao (CN); Zhaoji Li, Qingdao (CN); Yanpeng Zhu, Qingdao (CN); Baolong Chen, Qingdao (CN)

(73) Assignee: Shandong University of Science and Technology, Qingdao (CN)

( * ) Notice: Subject to any disclaimer, the term of this patent is extended or adjusted under 35 U.S.C. 154(b) by 267 days.

(21) Appl. No.: 18/197,894

(22) Filed: May 16, 2023

(65) Prior Publication Data

US 2024/0026788 A1 Jan. 25, 2024

(30) Foreign Application Priority Data

Jul. 20, 2022 (CN) ..... 202210851034.6

(51) Int. Cl.
*E21D 23/03* (2006.01)
*E21D 23/00* (2006.01)
(Continued)

(52) U.S. Cl.
CPC ..... *E21D 23/03* (2013.01); *E21D 23/0047* (2013.01); *E21D 23/0069* (2013.01);
(Continued)

(58) Field of Classification Search
CPC . E21D 23/03; E21D 23/0427; E21D 23/0047; E21D 23/0069; E21D 23/16
(Continued)

(56) References Cited

U.S. PATENT DOCUMENTS 3,848,928 A * 11/1974 Nakajima ..... E21D 23/066 299/33
4,269,546 A * 5/1981 Saunders ..... E21D 23/066 405/294
(Continued)

FOREIGN PATENT DOCUMENTS

AU 2012253219 A1 * 11/2013 ..... E21D 23/0091
CN 101970795 B * 6/2013 ..... E21C 35/12
(Continued)

*Primary Examiner* — Frederick L Lagman
(74) *Attorney, Agent, or Firm* — Master Key IP, LLP; Justin G. Sanders

(57) ABSTRACT

The present disclosure relates to a hydraulic support with a quick response function for coal wall spalling, which includes a base, an upright post, a top beam, an extensible canopy, a face guard, and a vibration meter. The vibration meter is mounted on a hydraulic support, and detects a vibration signal of a coal wall in a non-contact mode. The face guard includes a primary face guard, a secondary face guard, and a tertiary face guard connected in sequence. One side, close to a coal wall, of the primary face guard is connected to a quick response device. The quick response device is in signal communication with the vibration meter. After receiving the vibration signal of the coal wall, the quick response device is abutted against the coal wall before the secondary face guard and the tertiary face guard fit the coal wall.

8 Claims, 13 Drawing Sheets

(51) Int. Cl.
*E21D 23/04* (2006.01)
*E21D 23/16* (2006.01)
*E21F 17/18* (2006.01)

(52) U.S. Cl.
CPC ..... *E21D 23/0427* (2013.01); *E21D 23/16* (2013.01); *E21F 17/18* (2013.01)

(58) Field of Classification Search
USPC ..... 405/296
See application file for complete search history.

(56) References Cited

U.S. PATENT DOCUMENTS 4,747,729 A * 5/1988 Urschitz ..... E21D 23/0454
405/299
8,562,077 B2 * 10/2013 Junker ..... E21D 23/03
299/1.05

FOREIGN PATENT DOCUMENTS

CN 105332729 A * 2/2016 ..... E21D 20/00
CN 106437808 A * 2/2017 ..... E21D 23/04
CN 110056383 A * 7/2019 ..... E21D 15/51
CN 112780325 A * 5/2021 ..... E21D 23/03
CN 114508375 A * 5/2022
WO WO-2018094705 A1 * 5/2018 ..... E21D 23/04

* cited by examiner

HYDRAULIC SUPPORT WITH QUICK RESPONSE FUNCTION FOR COAL WALL SPALLING

RELATED APPLICATIONS

This patent application claims the benefit and priority of Chinese Patent Application No. 202210851034.6 filed with the China National Intellectual Property Administration on Jul. 20, 2022, the disclosure of which is incorporated by reference herein in its entirety as part of the present application.

BACKGROUND

The present disclosure relates to the field of coal mining mechanical equipment, and in particular, to a hydraulic support with a quick response function for coal wall spalling.

The comprehensive mechanized mining with a large mining height is one of main mining methods for a hard and thick coal seam with the thickness of more than 3.5 m. However, as a mining height increases gradually, the probability of coal wall spalling also increases. The coal wall spalling is easy to cause the roof fall of the end face, which further deteriorates mining conditions of a working face, results in uneven stress on a hydraulic support, causes damage to support components, and even threatens the personal safety of production personnel. Under the condition of certain mining parameters of the working face, a reasonable wall protecting structure of the hydraulic support is the most effective method for inhibiting the coal wall spalling.

By performing stress analysis on different wall protecting structures, it is found that a split structure design of an extensible canopy and a face guard has a greater supporting acting force on the coal wall, which can apply an active horizontal acting force on the coal wall through a telescopic jack. However, since a primary face guard of the split structure of the face guard and the extensible canopy cannot be in contact with the coal wall and only a secondary face guard and a tertiary face guard apply active supporting acting forces to the coal wall, an effective support area of the split structure on the coal wall is reduced. Moreover, jacks of both the extensible canopy and the face guard use hydraulic systems, which have low transmission efficiency and low action speed. During a time period when the extensible canopy extends out to the secondary face guard and the tertiary face guard to fully fit the coal wall after a coal mining machine completes coal cutting, spalling cannot be prevented quickly and effectively.

In addition, at the present stage, most coal wall condition monitoring is based on sensor technology and adopts contact measurement methods. A large number of pieces of sensor equipment need to be mounted, the cost is high, the installation is complicated, the efficiency is low, and the maintenance is difficult. In addition, a complex mine environment and the existence of electromagnetic interference will lead to inaccurate measurement results, thereby affecting a wall protecting effect.

SUMMARY

The present disclosure aims to solve the above problems, and provides a hydraulic support with a quick response function for coal wall spalling, which adopts the following technical scheme:

A hydraulic support with a quick response function for coal wall spalling includes a base, an upright post, a top beam, an extensible canopy, a face guard, and a vibration meter. The vibration meter is mounted on a hydraulic support, and detects a vibration signal of a coal wall in a non-contact mode. The face guard includes a primary face guard, a secondary face guard, and a tertiary face guard connected in sequence. One side, close to a coal wall, of the primary face guard is connected to a quick response device. The quick response device is in signal communication with the vibration meter. The quick response device is abutted against the coal wall after receiving the vibration signal of the coal wall and before the secondary face guard and the tertiary face guard fit the coal wall.

On the basis of the above scheme, the quick response device includes a second motor, connecting rod mechanisms, and an auxiliary face guard. The second motor is mounted below the top beam. The second motor is in signal communication with the vibration meter. The connecting rod mechanisms are driven by the second motor, and drive the auxiliary face guard to rotate.

On the basis of the above scheme, each of the connecting rod mechanisms includes a supporting rod, a first connecting rod, a second connecting rod, a third connecting rod, and a fourth connecting rod. Two ends of the first connecting rod are respectively hinged to the top end of the auxiliary face guard and one end of the fourth connecting rod; the other end of the fourth connecting rod is hinged to the top beam; two hinge holes in an extending direction of the first connecting rod (42) are formed in the middle of the first connecting rod; one end of the supporting rod is hinged to a middle of a side surface of the auxiliary face guard; the other end of the supporting rod is hinged to a hinge hole, close to one side of the auxiliary face guard, in the middle of the first connecting rod; one end of the second connecting rod is hinged to a hinge hole, close to one side of the fourth connecting rod, in the middle of the first connecting rod; the other end of the second connecting rod is hinged to one end of the third connecting rod; and the other end of the third connecting rod is connected to the second motor, and is driven to be rotated by the second motor.

Preferably, the quick response device further includes a telescopic plate. The telescopic plate is arranged in parallel with the auxiliary face guard, and slides reciprocally along the auxiliary face guard.

On the basis of the above scheme, the auxiliary face guard is provided with a first motor and a gear; the first motor (32) drives the gear to rotate; the telescopic plate is fixedly connected with a gear rack in a movement direction thereof; and the gear rack is meshed with the gear.

Preferably, the vibration meter includes a fixed rod, a movable rod, a housing, and a lens connected in sequence. Two ends of the movable rod are in a hinged form. A laser, a first beam splitter, and a second beam splitter are sequentially arranged in the horizontal direction at a height of the lens in the housing. The second beam splitter is arranged between the first beam splitter and the lens. A reflector is arranged below the first beam splitter. A third beam splitter is arranged below the second beam splitter. A phase modulator is arranged between the reflector and the third beam splitter. A detector is arranged below the third beam splitter.

On the basis of the above scheme, the fixed rod is fixedly connected to the upright post.

Preferably, the hydraulic support with a quick response function for coal wall spalling further includes a controller and an electrohydraulic valve group. The controller is in signal communication with the vibration meter and the quick response device.

The present disclosure has the following beneficial effects:

1. real-time and large-area monitoring of coal wall conditions is performed by using laser vibration measurement technology, and measurement data information is accurately transmitted and processed to realize early-warning for coal wall spalling;
2. the quick response device adopts an electrical control and mechanical transmission mechanism, quickly makes action response after receiving the coal wall vibration signal, can press against the coal wall timely and quickly before the face guard controlled by a hydraulic element plays a role of supporting, so as to perform temporary wall protection, and realize quick, efficient, large-area, and in-time automatic response to wall protection; and the relative positions of the telescopic plate and a temporary face guard can be adjusted according to an area that needs to be subjected to wall protection, so as to adjust an area of temporary wall protection;
3. before the face guard extends out, the quick response plate is arranged between the top beam and the primary face guard in a retracted state, and no extra space is occupied; after the face guard completes a supporting action, the quick response device is retracted onto the primary face guard, so as to avoid a problem of poor face guard effect caused by interfering with the face guard of the hydraulic support; and
4. the above devices such as the quick response device and the vibration meter may be mounted and improved on the structure of the existing hydraulic support, which can effectively expand the application range of the structure.

BRIEF DESCRIPTION OF THE DRAWINGS

The accompanying drawings illustrate aspects of the present invention. In such drawings.

Figure 1:
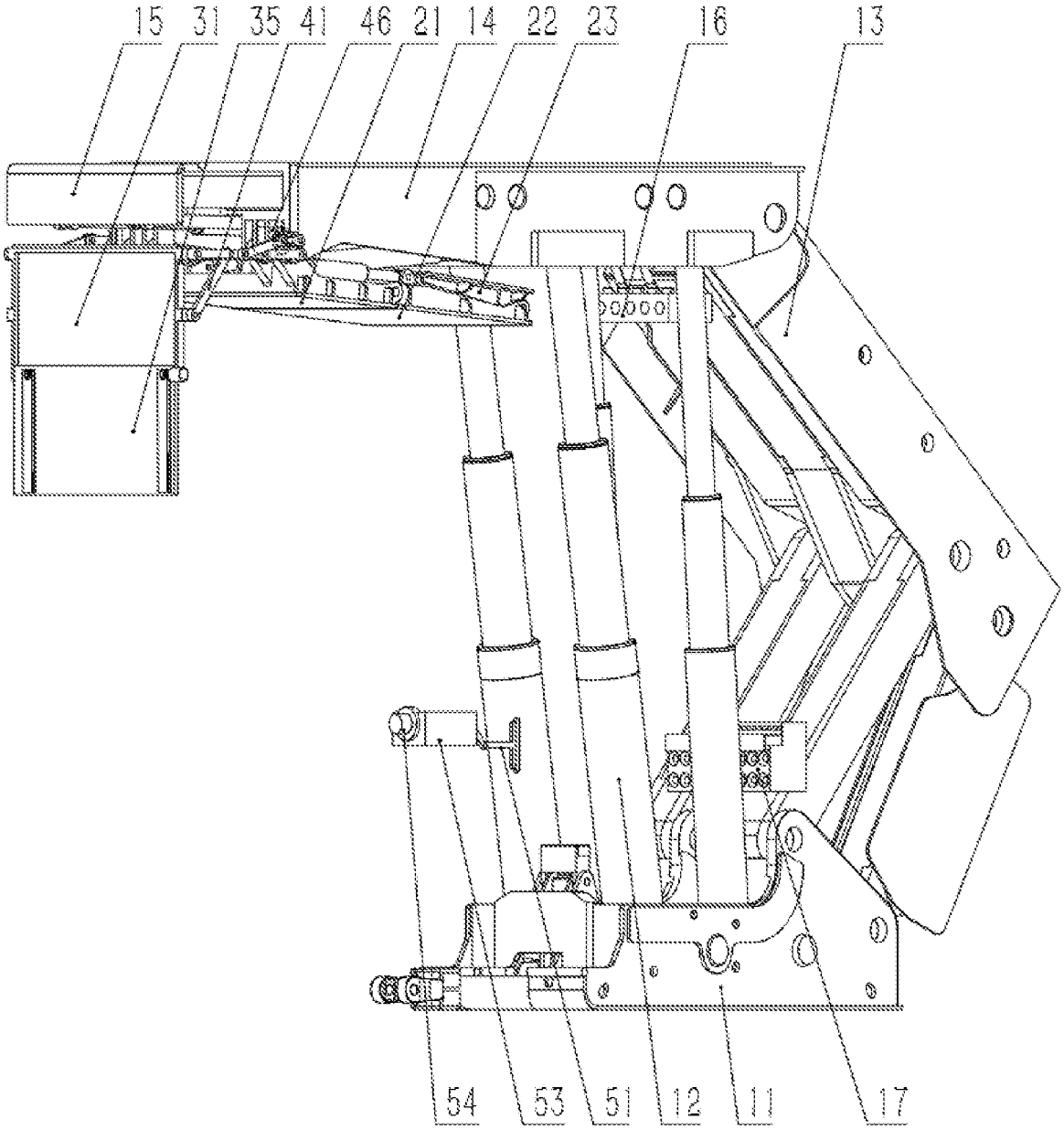
FIG. 1: a schematic structural diagram of the present disclosure.

The above-described drawing figures illustrate aspects of the invention in at least one of its exemplary embodiments, which are further defined in detail in the following description. Features, elements, and aspects of the invention that are referenced by the same numerals in different figures represent the same, equivalent, or similar features, elements, or aspects, in accordance with one or more embodiments.

DETAILED DESCRIPTION

The present disclosure is further illustrated by the following examples in conjunction with the accompanying drawings.

In the present disclosure, unless otherwise definitely specified and limited, terms "mount", "mutually connect", "connect", "fix", and the like should be broadly understood. For example, the terms may refer to fixed connection and may also refer to detachable connection or integration. The terms may refer to mechanical connection and may also refer to electrical connection or mutual communication. The terms may refer to direct mutual connection, may also refer to indirect connection through a medium, and may refer to communication in two components or an interaction relationship of the two components. For those of ordinary skill in the art, specific meanings of the above terms in the present disclosure may be understood according to specific situations.

In the descriptions of the present disclosure, it is to be understood that orientations or positional relationships indicated by the terms "center", "length", "width", "upper", "lower", "front", "rear", "left", "right", "vertical", "horizontal", "top", "bottom", "inside", and the like are the orientations or positional relationships shown based on the drawings, and are merely for the convenience of describing the present disclosure and simplifying the description, rather than indicating or implying that the devices or elements must have particular orientations, and constructed and operated in particular orientations, and therefore, the above terms shall not be construed as a limitation to the present disclosure. In addition, terms "first" and "second" are only adopted for description and should not be understood to indicate or imply relative importance or implicitly indicate the number of indicated technical features. Therefore, the features limited by "first" or "second" may explicitly or implicitly include one or more features. In the descriptions of the embodiments of the present disclosure, "plurality" means at least two, unless otherwise specified.

In the present disclosure, unless otherwise explicitly specified and defined, a first feature "above" or "below" of a second feature may include that the first feature is in direct contact the second features, or may include that the first and second features are not in direct contact, but in contact through other features therebetween. In addition, the first feature "above", "over", and "on" the second feature, includes that the first feature is directly above and obliquely above the second feature, or only means that the horizontal height of the first feature is higher than that of the second feature. The first feature "under", "below", and "underneath" the second feature includes that the first feature is directly below and obliquely below the second feature, or only means that the horizontal height of the first feature is lower than that of the second feature.

As shown in FIG. 1, a hydraulic support with a quick response function for coal wall spalling includes common devices of the existing hydraulic support such as a base 11, an upright post 12, a side protective plate 13, a top beam 14, an extensible canopy 15 and a face guard, and includes a vibration meter and a quick response device. The vibration meter is mounted on a hydraulic support, and is used for measuring a vibration signal of a coal wall in a non-contact mode. The hydraulic support with a quick response function for coal wall spalling further includes a controller 16 and an electrohydraulic valve group 17. The electrohydraulic valve group 17 controls mechanisms such as the upright post 12 and the face guards and other mechanisms to act. The controller 16 is in signal communication with the vibration meter and the quick response device.

Figure 3:
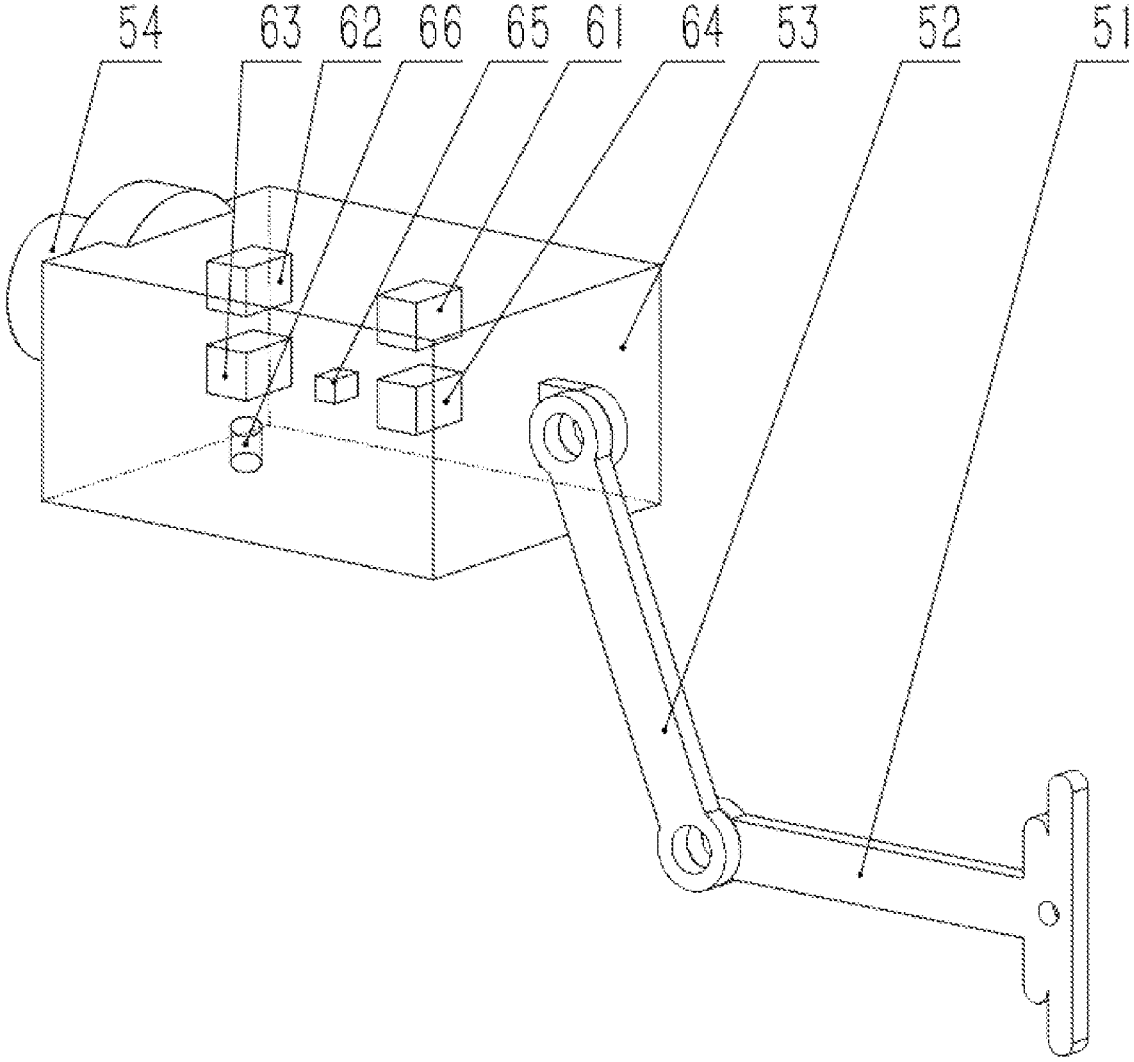
FIG. 3: a schematic diagram of an internal structure of a vibration meter of the present disclosure.
Figure 4:
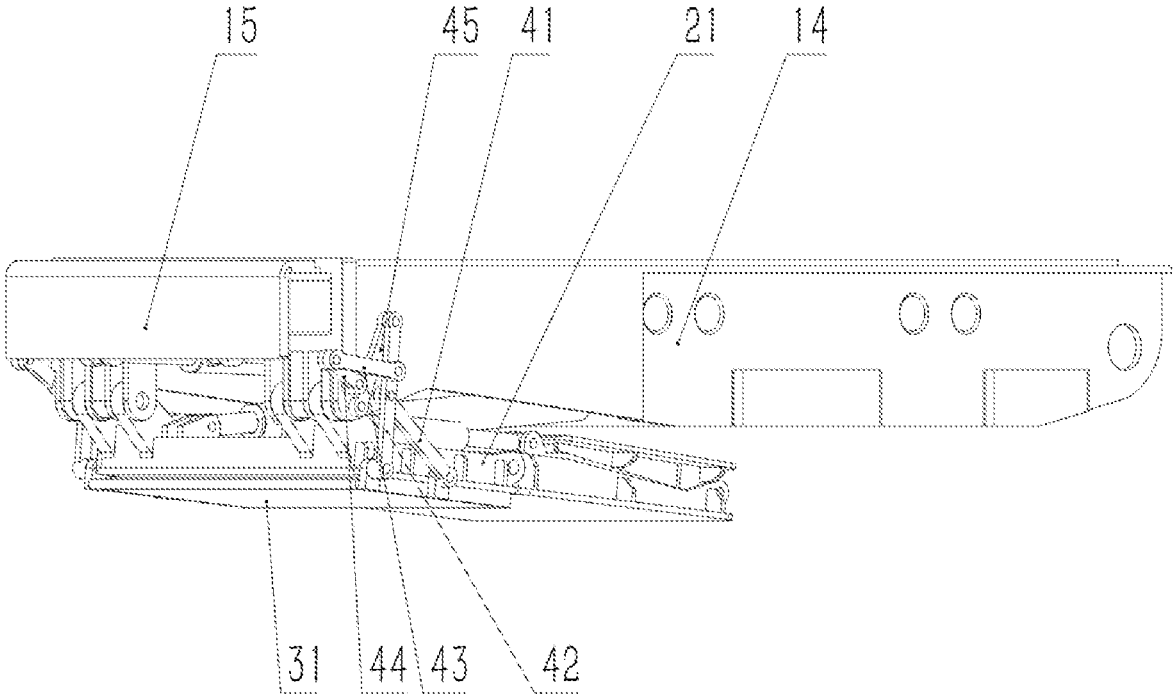
FIG. 4: a first state diagram of a stretching process of the quick response device of the present disclosure.
Figure 5:
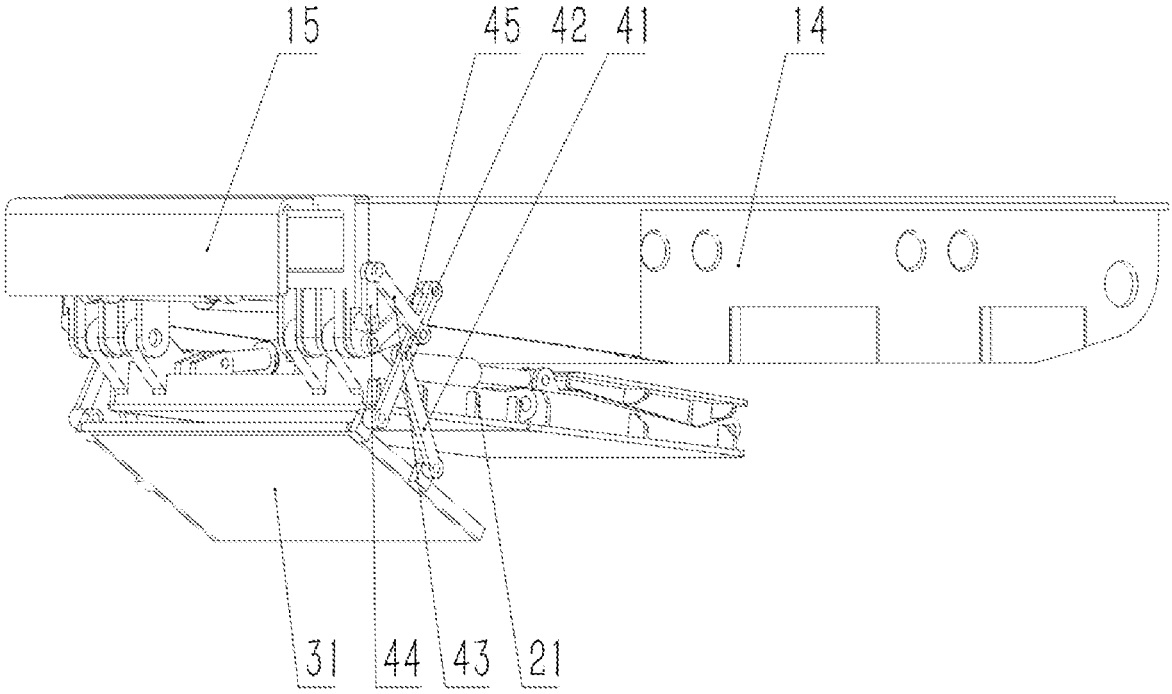
FIG. 5: a second state diagram of a stretching process of the quick response device of the present disclosure.
Figure 6:
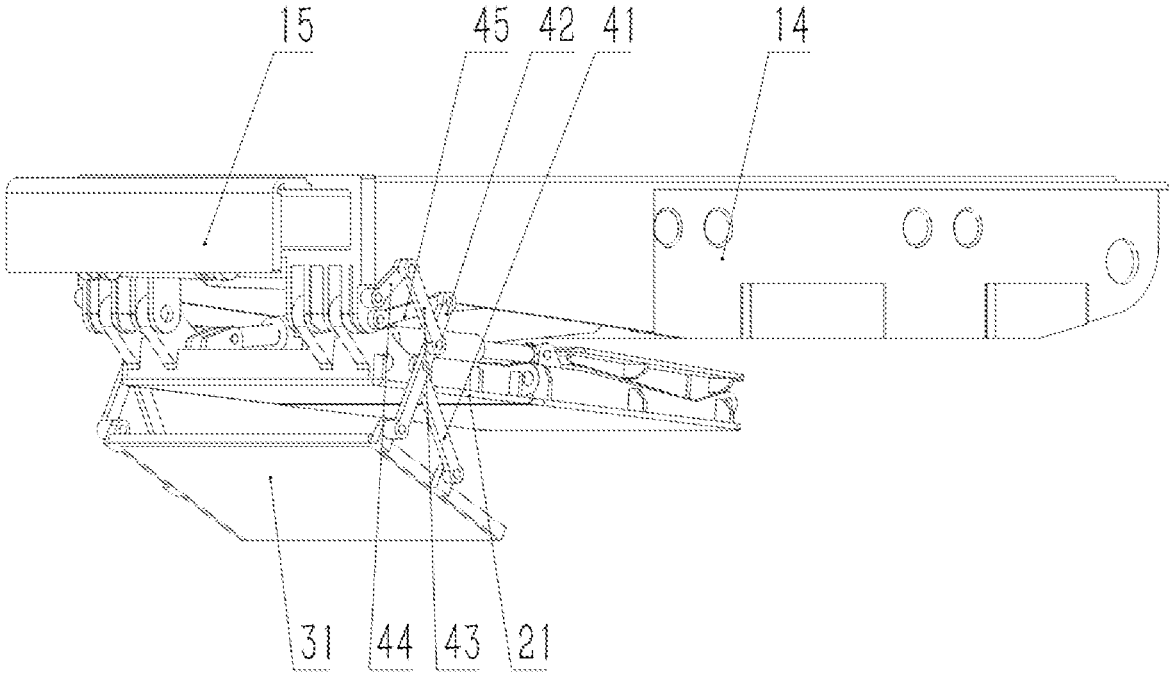
FIG. 6: a third state diagram of a stretching process of the quick response device of the present disclosure.
Figure 7:
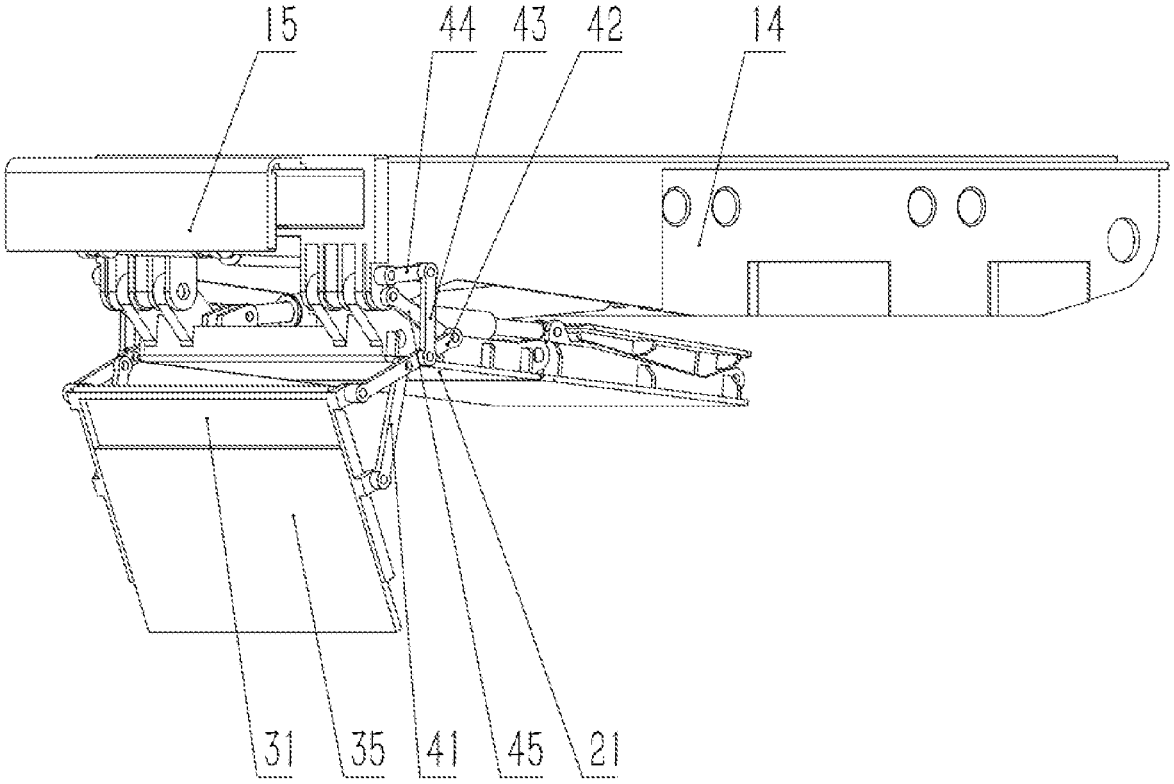
FIG. 7: a fourth state diagram of a stretching process of the quick response device of the present disclosure.
Figure 8:
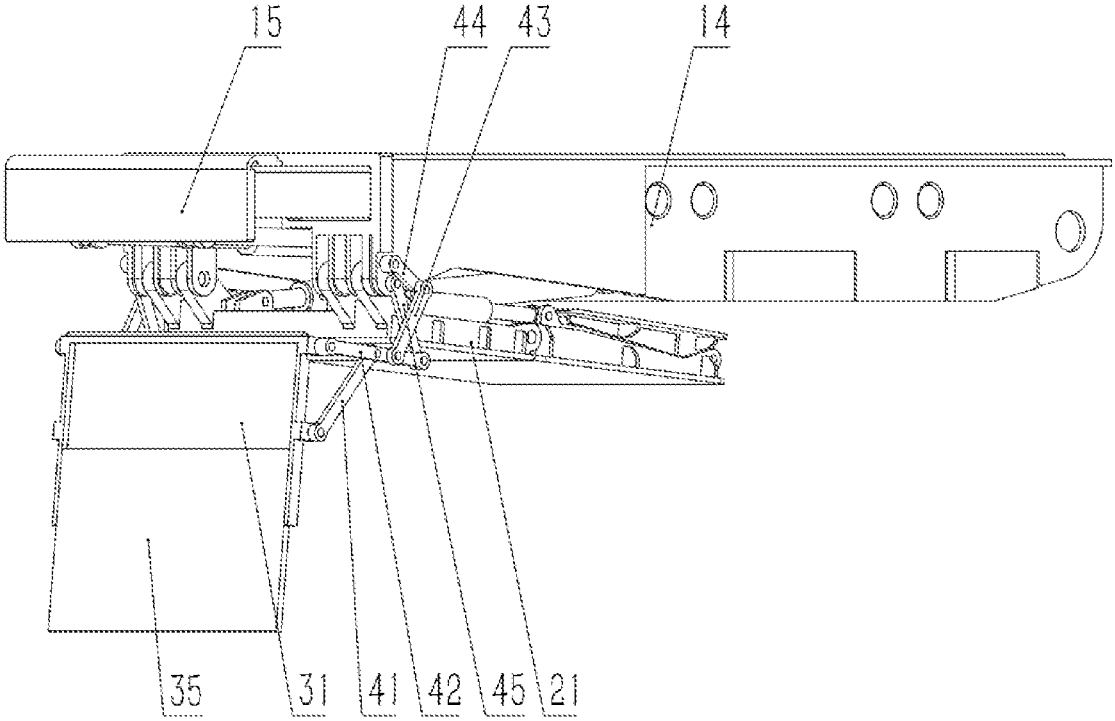
FIG. 8: a fifth state diagram of a stretching process of the quick response device of the present disclosure.
Figure 9:
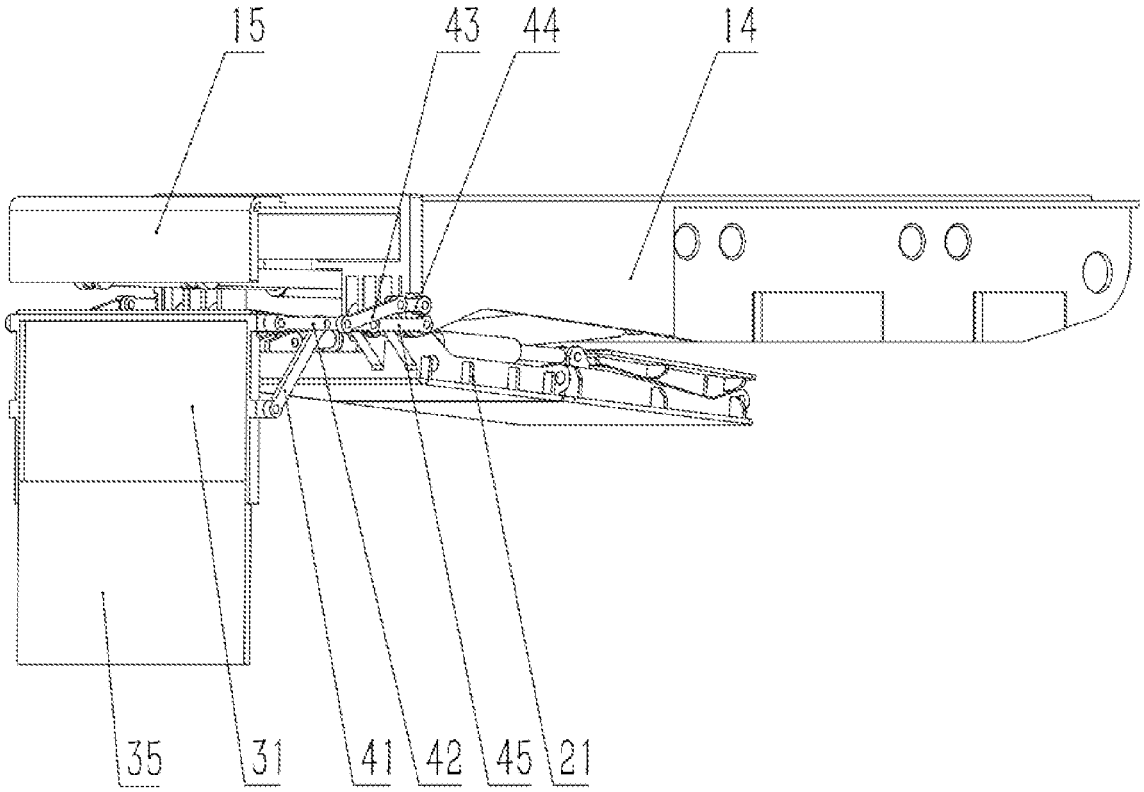
FIG. 9: a sixth state diagram of a stretching process of the quick response device of the present disclosure.
Figure 10:
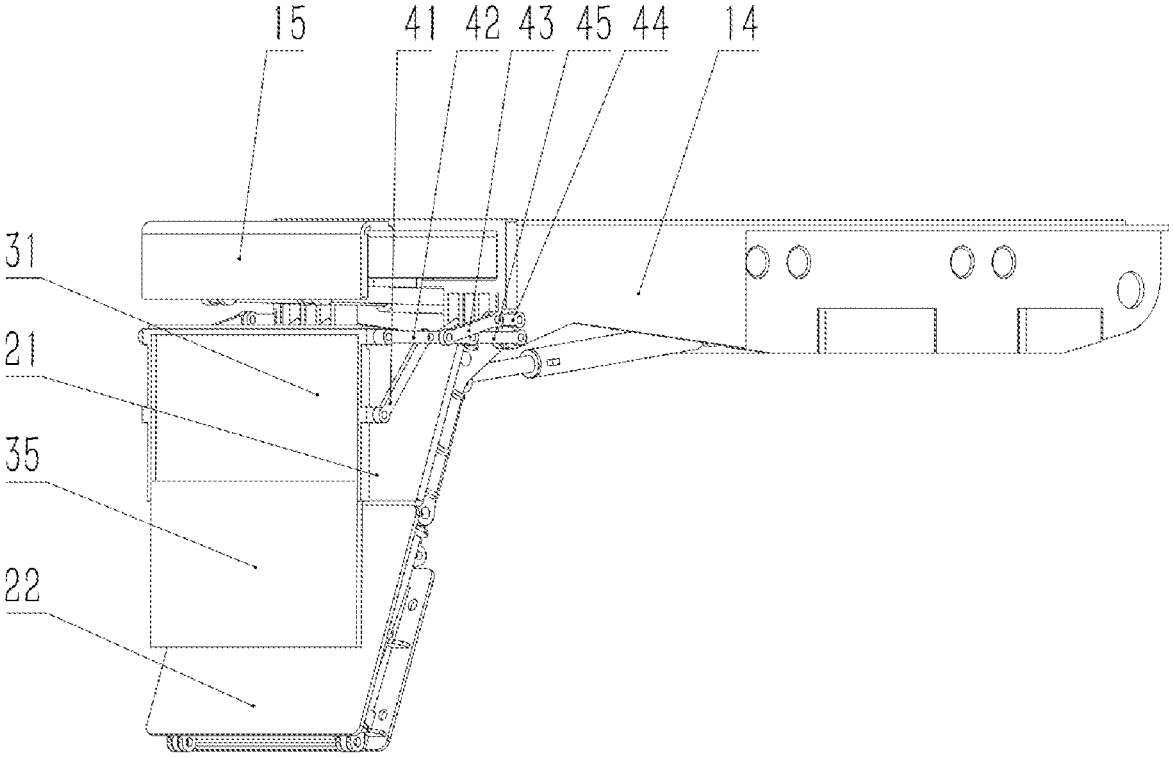
FIG. 10: a first state diagram of a retracting process of the quick response device of the present disclosure.
Figure 11:
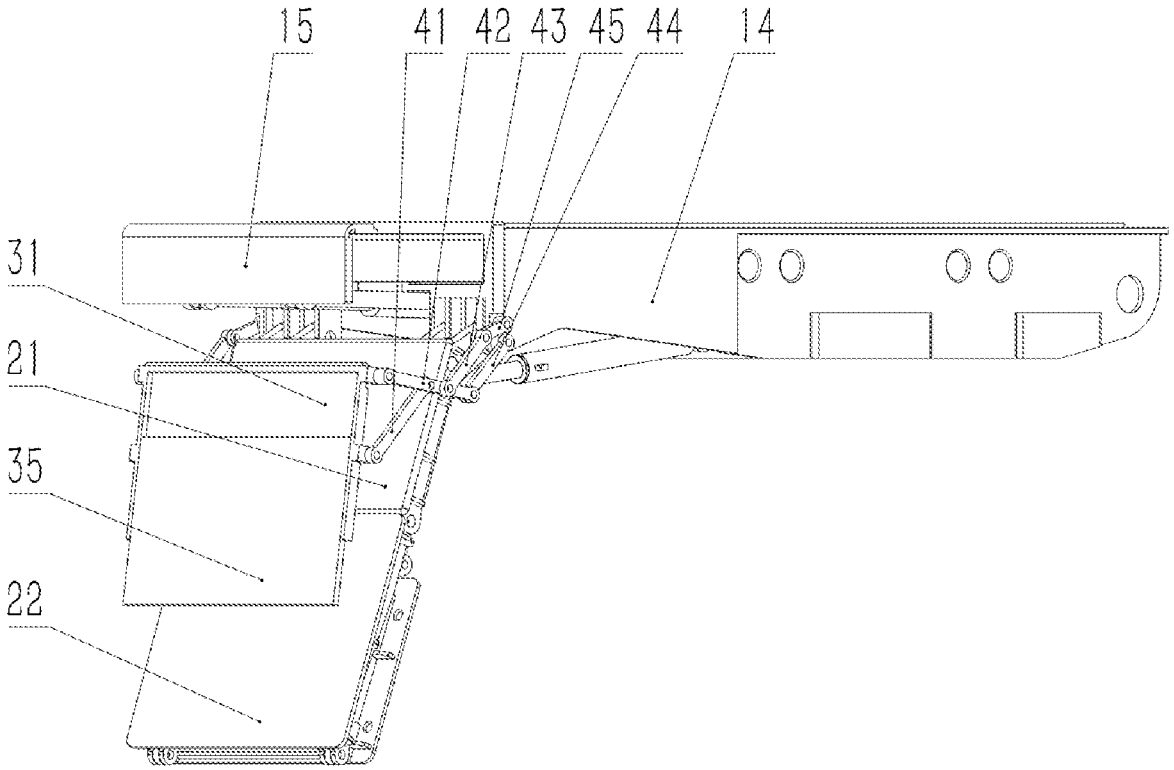
FIG. 11: a second state diagram of a retracting process of the quick response device of the present disclosure.
Figure 12:
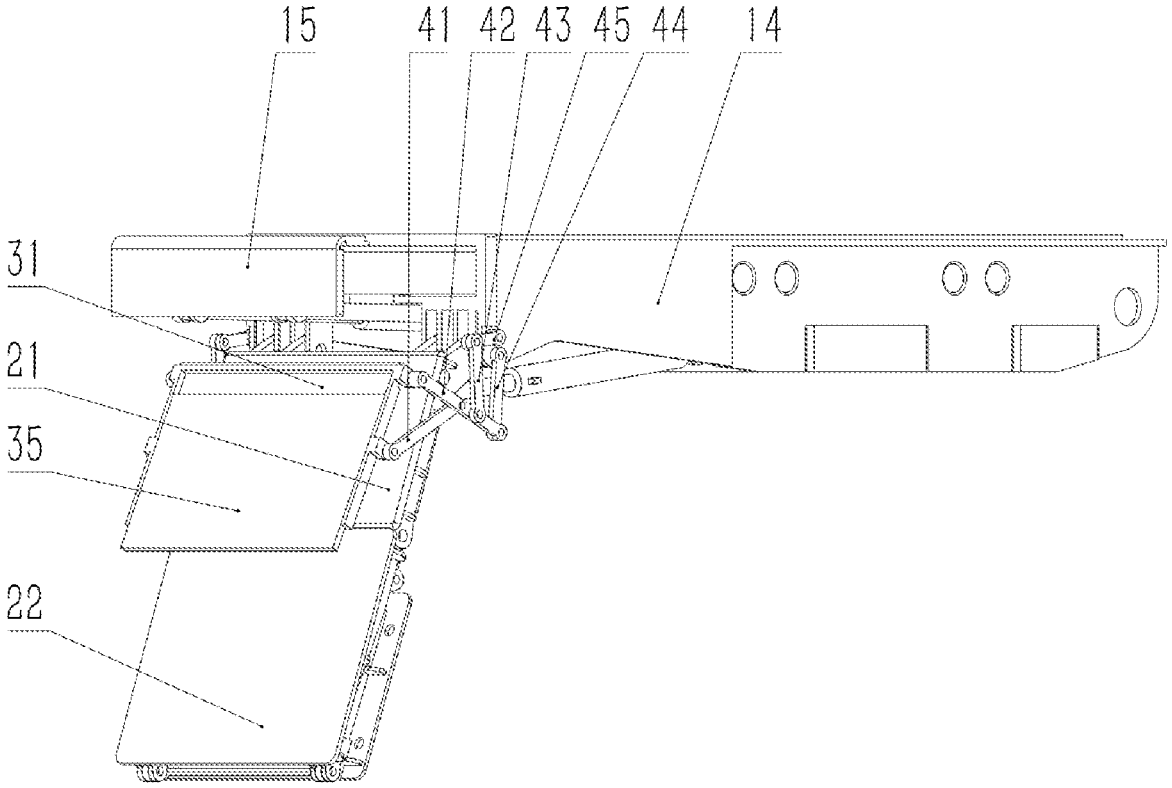
FIG. 12: a third state diagram of a retracting process of the quick response device of the present disclosure.
Figure 13:
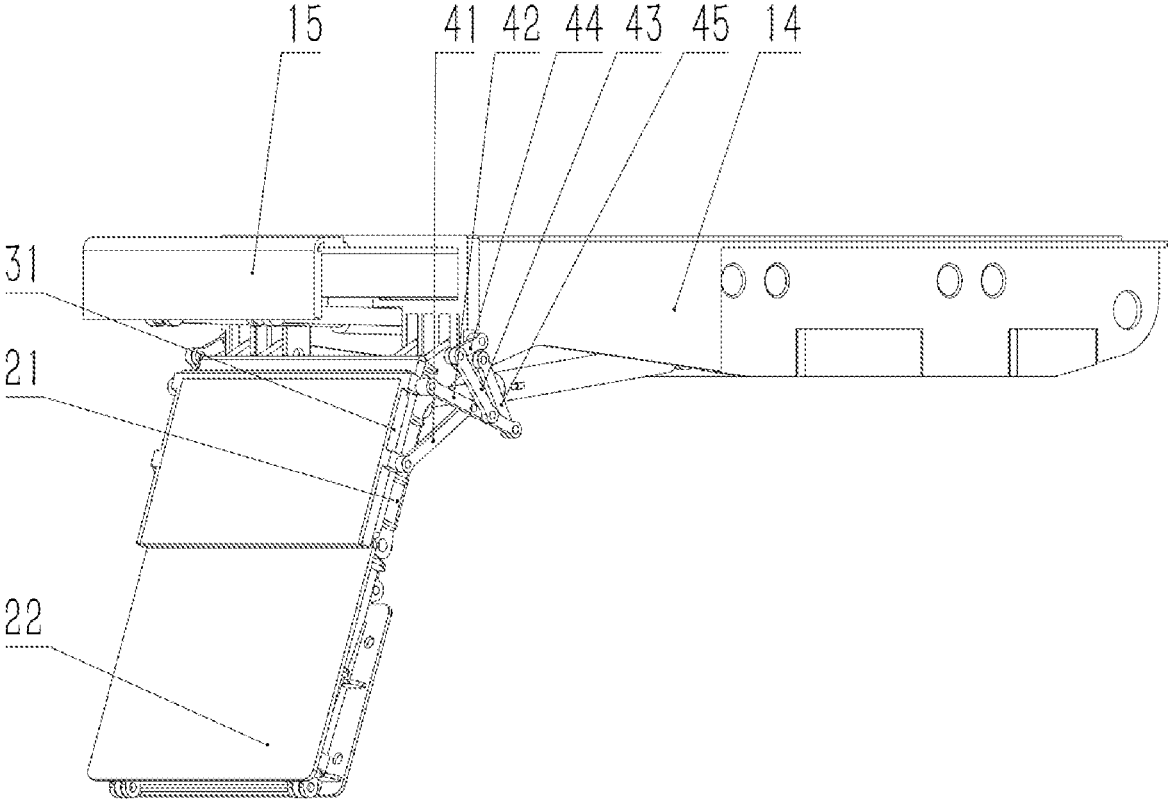
FIG. 13: a fourth state diagram of a retracting process of the quick response device of the present disclosure.

Specifically, as shown in FIG. 3, the vibration meter includes a fixed rod 51, a movable rod 52, a housing 53, and a lens 54 connected in sequence. The fixed rod 51 is fixedly connected to the upright post 12. Two ends of the movable rod 52 are in a hinged form; a laser, a first beam splitter 61, and a second beam splitter 62 are sequentially arranged in the horizontal direction at a height of the lens 54 in the housing 53; the second beam splitter 62 is arranged between the first beam splitter 61 and the lens 54; a reflector 64 is arranged below the first beam splitter 61; a third beam splitter 63 is arranged below the second beam splitter 62; a phase modulator 65 is arranged between the reflector 64 and the third beam splitter 63; and a detector 66 is arranged below the third beam splitter 63. A laser beam emitted by the laser is divided into a reference beam and a measurement beam through the first beam splitter 61. The measurement beam is focused and reflected on the coal wall after passing through the second beam splitter 62 and the lens 54, and the reflected beam is downward deflected to the third beam splitter 63 through the second beam splitter 62. The reference beam reaches the third beam splitter 63 after passing through the reflector 64 and the phase modulator 65 in sequence. The reference beam and the measurement beam are merged and then reach the detector 66. When the coal wall vibrates, a light beam will interfere to generate bright/dark fringes on the detector 66. A complete bright/dark periodic fringe on the detector 66 just corresponds to the displacement of half wavelength of the used laser light. Thus, vibration information of the coal wall can be detected. The vibration information is sent to the controller 16, and the controller 16 sends to an action command to the quick response device 30.

Figure 2:
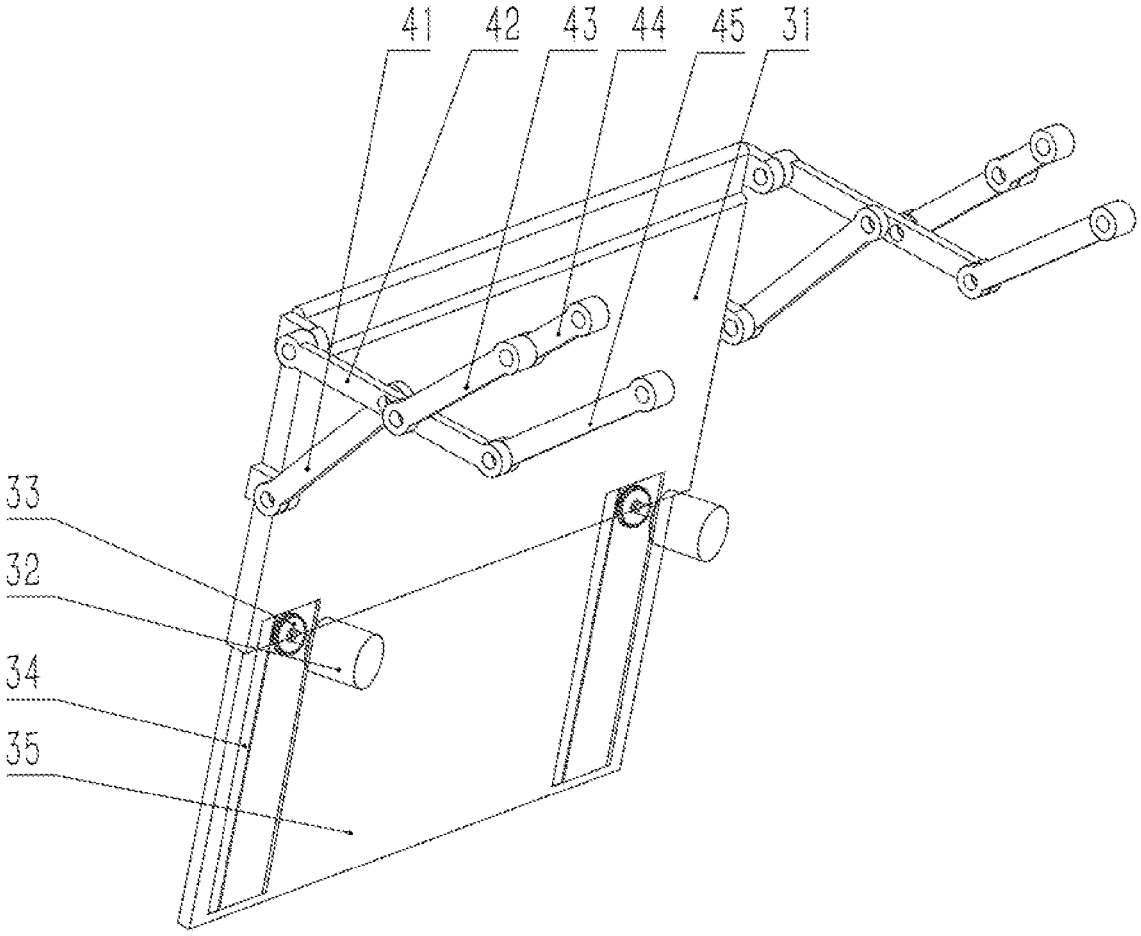
FIG. 2: a schematic structural diagram of a quick response device of the present disclosure.

The face guard includes a primary face guard 21, a secondary face guard 22, and a tertiary face guard 23 connected in sequence. One side, close to a coal wall, of the primary face guard 21 is connected to a quick response device; the quick response device is in signal communication with the vibration meter; and the quick response device is abutted against the coal wall after receiving the vibration signal of the coal wall and before the secondary face guard 22 and the tertiary face guard 23 is attached to the coal wall. Specifically, as shown in FIG. 2, the quick response device includes a second motor 46, connecting rod mechanisms, and an auxiliary face guard 31. The second motor 46 is mounted below the top beam 14. The second motor 46 is in signal communication with the vibration meter. The connecting rod mechanisms are driven by the second motor 46, and drive the auxiliary face guard 31 to rotate. The connecting rod mechanisms are symmetrically arranged at two ends of the top of the auxiliary face guard 31 to symmetrically control the posture of the auxiliary face guard 31. Each of the connecting rod mechanisms includes a supporting rod 41, a first connecting rod 42, a second connecting rod 43, a third connecting rod 44, and a fourth connecting rod 45. Two ends of the first connecting rod 42 are respectively hinged to the top end of the auxiliary face guard 31 and one end of the fourth connecting rod 45. The other end of the fourth connecting rod 45 is hinged to the top beam 14. Two hinge holes in an extending direction of the first connecting rod 42 are formed in the middle of the first connecting rod 42. One end of the supporting rod 41 is hinged to a middle of a side surface of the auxiliary face guard 31; and the other end of the supporting rod 41 is hinged to a hinge hole, close to one side of the auxiliary face guard 31, in the middle of the first connecting rod 42. One end of the second connecting rod 43 is hinged to a hinge hole, close to one side of the fourth connecting rod 45, in the middle of the first connecting rod 42; and the other end of the second connecting rod 43 is hinged to one end of the third connecting rod 44. The other end of the third connecting rod 44 is connected to the second motor 46, and is driven to rotate by the second motor 46.

When the quick response device receives a vibration signal from the controller 16, auxiliary supporting is performed before the face guard completes a supporting action, and state change diagrams are as shown in FIG. 4 to FIG. 9. The second motor 46 drives the third connecting rod 44 to rotate in a clockwise direction, so that the second connecting rod 43 drives the first connecting rod 42 and the fourth connecting rod 45 to rotate in the clockwise direction. The rotating speed of each rod is different until the auxiliary face guard 31 abuts against the coal wall in a vertical state to perform temporary support. At this moment, the supporting rod 41, the first connecting rod 42, and the auxiliary face guard 31 constitute a triangular structure to strengthen the support strength of the auxiliary protective plate 31 on the coal wall. After devices such as the hydraulic cylinder that drives all of face guards receive the vibration signal and drive the secondary face guard 22 and the tertiary face guard 23 to complete the supporting action and to abut against the coal wall, the quick response device receives a signal and is retracted gradually, and state change diagrams are shown in FIG. 10 to FIG. 13. The second motor 46 drives the third connecting rod 44 to rotate in an anticlockwise direction, so that the second connecting rod 43 drives the first connecting rod 42 and the fourth connecting rod 45 to rotate in the anticlockwise direction. However, the supporting rod 41 rotates in the clockwise direction, and the rotating speed of each rod is different until the auxiliary face guard 31 is attached to the primary face guard 21.

Preferably, the quick response device further includes a telescopic plate 35. The telescopic plate 35 is arranged in parallel with the auxiliary face guard 31, and slides reciprocally along the auxiliary face guard 31. The telescopic plate 35 may be retracted to the inside or one side of the auxiliary face guard 31 in a retracted state. The auxiliary face guard 31 is provided with a first motor 32 and a gear 33. The gear 33 is driven to rotate by the first motor 32. The telescopic plate 35 is fixedly connected with a gear rack 34 in a movement direction thereof. The gear rack 34 is meshed with the gear 33. The first motor 32 drives the gear 33 to rotate to adjust the position of the telescopic plate 35 relative to the auxiliary face guard 31. The longer the extension length of the telescopic plate 35, the larger the support area for the coal wall, thus adjusting the support area according to the area of the coal wall to be supported. Preferably, the first motor 32 may be arranged on one side, close to the primary face guard 21, of the auxiliary face guard 31. A surface of the primary face guard 21 is provided with an avoiding slot according to the volume and the position of the first motor 32.

The present disclosure has been described above by way of example, but the present disclosure is not limited to the specific embodiments above. Any modifications or variations made based on the present disclosure belong to the scope of protection claimed by the present disclosure.

What is claimed is:

1. A hydraulic support with a quick response function for coal wall spalling, comprising:

a base, an upright post, a top beam, an extensible canopy, a face guard, and a vibration meter, wherein the vibration meter is mounted on a hydraulic support, and detects a vibration signal of a coal wall in a non-contact mode;

the face guard comprises a primary face guard, a secondary face guard, and a tertiary face guard connected in sequence; one side, close to the coal wall, of the primary face guard is connected to a quick response device;

the quick response device is in signal communication with the vibration meter; and the quick response device is abutted against the coal wall after receiving the vibration signal of the coal wall and before the secondary face guard and the tertiary face guard attach to the coal wall.

2. The hydraulic support with a quick response function for coal wall spalling according to claim 1, wherein:

the quick response device comprises a second motor, connecting rod mechanisms, and an auxiliary face guard;

the second motor is mounted below the top beam;

the second motor is in signal communication with the vibration meter; and the connecting rod mechanisms are driven by the second motor, and drives the auxiliary face guard to rotate.

3. The hydraulic support with a quick response function for coal wall spalling according to claim 2, wherein:

each of the connecting rod mechanisms comprises a supporting rod, a first connecting rod, a second connecting rod, a third connecting rod, and a fourth connecting rod;

two ends of the first connecting rod are respectively hinged to the top end of the auxiliary face guard and one end of the fourth connecting rod;

the other end of the fourth connecting rod is hinged to the top beam;

two hinge holes in an extending direction of the first connecting rod are formed in the middle of the first connecting rod;

one end of the supporting rod is hinged to a middle of a side surface of the auxiliary face guard;

an other end of the supporting rod is hinged to one of the two hinge holes, close to the auxiliary face guard, in the middle of the first connecting rod;

one end of the second connecting rod is hinged to one of the two hinge holes, close to the fourth connecting rod, in the middle of the first connecting rod;

an other end of the second connecting rod is hinged to one end of the third connecting rod; and an other end of the third connecting rod is connected to the second motor, and is driven to rotate by the second motor.

4. The hydraulic support with a quick response function for coal wall spalling according to claim 2, wherein:

the quick response device further comprises a telescopic plate; and the telescopic plate is arranged in parallel with the auxiliary face guard, and slides reciprocally along the auxiliary face guard.

5. The hydraulic support with a quick response function for coal wall spalling according to claim 4, wherein:

the auxiliary face guard is provided with a first motor and a gear;

the first motor drives the gear to rotate;

the telescopic plate is fixedly connected with a gear rack in a movement direction of the telescopic plate; and the gear rack is meshed with the gear.

6. The hydraulic support with a quick response function for coal wall spalling according to claim 1, wherein:

the vibration meter comprises a fixed rod, a movable rod, a housing, and a lens connected in sequence;

two ends of the movable rod are in a hinged form;

a laser, a first beam splitter, and a second beam splitter are sequentially arranged in the horizontal direction at a height of the lens in the housing;

the second beam splitter is arranged between the first beam splitter and the lens;

a reflector is arranged below the first beam splitter;

a third beam splitter is arranged below the second beam splitter;

a phase modulator is arranged between the reflector and the third beam splitter; and a detector is arranged below the third beam splitter.

7. The hydraulic support with a quick response function for coal wall spalling according to claim 6, wherein the fixed rod is fixedly connected to the upright post.

8. The hydraulic support with a quick response function for coal wall spalling according to claim 1, further comprising:

a controller and an electrohydraulic valve group; and the controller is in signal communication with the vibration meter and the quick response device.

* * * * *